United States Patent [19]

Kochey, Jr. et al.

[11] 4,013,024

[45] Mar. 22, 1977

[54] SLOTTED BAND TYPE SPACER FOR HIGH TEMPERATURE SUPERHEATER TUBES

[75] Inventors: Edward L. Kochey, Jr., Colebrook; Edward A. Hatch, Granby, both of Conn.

[73] Assignee: The Air Preheater Company, Inc., Wellsville, N.Y.

[22] Filed: Jan. 7, 1976

[21] Appl. No.: 647,036

[52] U.S. Cl. ..... 110/98 R; 122/510; 165/162

[51] Int. Cl.[2] ..... F23M 9/10; F22B 37/24

[58] Field of Search ..... 110/98 R; 122/510; 165/162, 172; 248/49, 68 R

[56] References Cited

UNITED STATES PATENTS

| | | | |
|---|---|---|---|
| 3,055,349 | 9/1962 | Hamilton et al. | 122/510 |
| 3,503,440 | 3/1970 | Romanos | 122/510 |
| 3,575,236 | 4/1971 | Romanos | 122/510 |
| 3,677,339 | 7/1972 | Perrin et al. | 122/510 |
| 3,854,529 | 12/1974 | Sagan | 122/510 |
| 3,929,189 | 12/1975 | Lecon | 122/510 |

*Primary Examiner*—Kenneth W. Sprague
*Attorney, Agent, or Firm*—Wayne H. Lang

[57] ABSTRACT

A band type spacing means that is used to maintain a predetermined spacing of elongate tubes as contained in a boiler furnace, superheater, or any of various types of reactor. The spacing means is adapted to combine simplicity of design and installation with the ability to remain continuously effective throughout a wide range of temperature and severe conditions of corrosion.

1 Claim, 3 Drawing Figures

SLOTTED BAND TYPE SPACER FOR HIGH TEMPERATURE SUPERHEATER TUBES

BACKGROUND OF THE INVENTION

In the construction of boilers that contain a multiplicity of elongate tubes in the manner common to boiler furnaces, heat exchangers, reactors and the like, it is essential that some means provide an arrangement by which the tubes are maintained spaced apart a predetermined distance. At lower temperatures, under about 1650° F, it has been customary to provide spacing strips on opposite sides of a row of tubes having overlapping tabs that are joined together between the tubes by a process of welding. While such an arrangement is suitable for use at lower temperatures, higher temperatures and severe conditions of corrosion cause weldments so made to rapidly deteriorate and crack, the strips to separate, the originally effective spacing means to come apart, and the spacing means to completely fail.

Various other aligning arrangements for tubes to be used at high temperatures and under severe conditions of corrosion have been used; however, such arrangements are invariably complicated, they require additional steps in the manufacturing and assemblying process, and they are consequently expensive to use.

SUMMARY OF THE INVENTION

This invention provides a spacing arrangement for use between each tube in a series of tubes that is adapted to remain effective throughout a wide range of temperature and for severe conditions of corrosion.

The spacing arrangement comprises essentially a first spacer strip lying at one side of a series of substantially parallel tubes. The spacer strip has a series of lateral tabs that extend normal thereto between adjacent tubes of the tube series. The end of each tab is directed through an elongate slot in a second metallic strip that lies on the opposite side of said series and it is essentially parallel to the first strip. After the individual tabs of the first strip are directed through coincident slots of the second strip, they are welded or otherwise secured thereto to provide a rigid assembly that surrounds each tube. The metallic strip having tabs lying between tubes may be stamped from heat resistant metal, so that even if the weld at the end of each tab should crack and fail, the tabs would continue to extend between the tubes and space them according to the predetermined requirements.

BRIEF DESCRIPTION OF THE DRAWING

The nature of the invention and its novel features will be more fully understood from the following description described in the specification and shown in the accompanying drawings in which.

DESCRIPTION OF THE INVENTION

Figure 1:
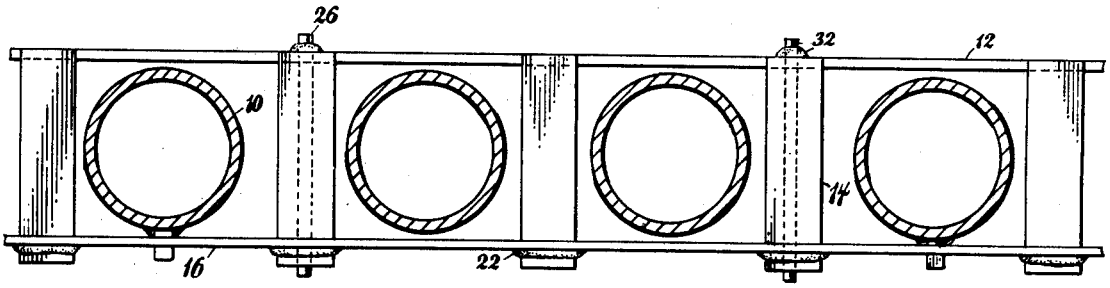
FIG. 1 is a perspective view of the device according to this invention.
Figure 2:
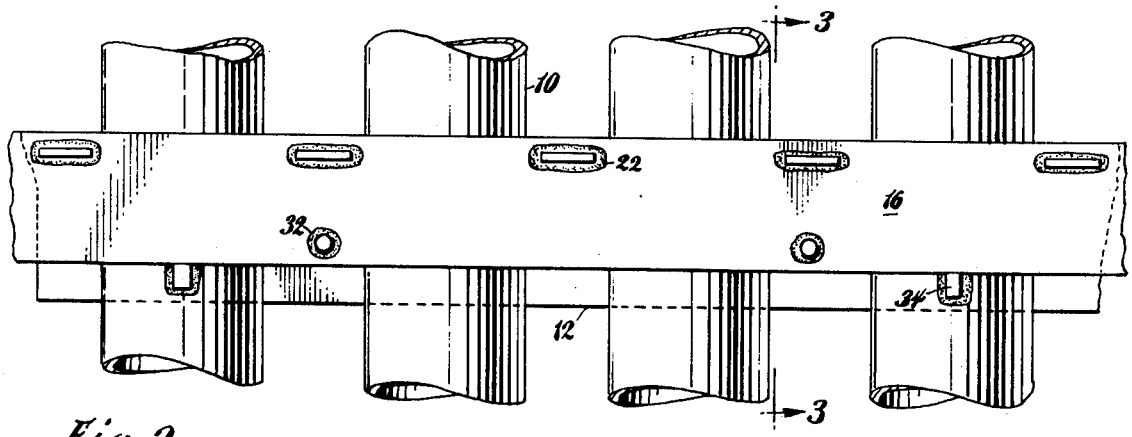
FIG. 2 is a cross-sectional view of the device as seen from 2—2.
Figure 3:
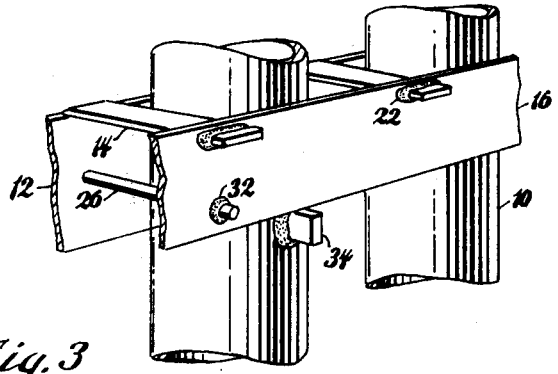
FIG. 3 is a partial perspective of the spacer showing the overall arrangement of the related parts as seen from line 3—3.

Referring more particularly to the drawing there is shown a spacer assembly for a series of spaced tubes 10 in a superheater, a reactor, or other type of heat exchanger.

The spacer assembly comprises a metallic strip 12 lying at the side of a tube bank and having a series of lateral projections or tabs 14 that extend into the space between each of tubes 10. The strip 12 is bent normal to the several tabs whereby said strip will lie parallel to the tubes and have a minimum of influence on the gases flowing thereby.

A second metallic strip 16 is essentially parallel to the first strip 12 and has a series of slots 18 therein adapted to receive the tabs 14 that extend laterally between the several tubes. In order that the first strip including the tabs 14 may be held permanently in position, the end of each tab 14 is secured as by a weldment 22 to the outboard side of slots in the strip 16 to collectively support the second strip 16 as a holding and handling expedient. If the welds 22 should crack and fail, the weldments would still have a significant function in that the remaining weld material would adhere to the end of the tabs or to the outboard side of strip 16 to produce sufficient interference that would prevent withdrawal of the tab from the slot.

To further stabilize the spacing arrangement, tie rods 26 are directed through spaced openings in the metallic strips 12 and 16 on the opposite sides of tubes 10. A clasping means such as a weldment 32 is then used to secure each tie rod securely to spaced strips at the sides of the series of spaced tubes. However, here, as with tabs 14 and the aligned slots, there will be no separation of the strip 12 from the strip 16 because the weld material remaining on the outboard side of strip 16 would cause interference at the end of each tie rod.

The entire spacer assembly is supported at a predetermined location adjacent a series of tubes by support lugs 34 on several of the elongate tubes. The lugs 34 are welded to several tubes of each series to provide a ledge on the upper surface thereof upon which the edge of strip 16 may rest.

While this invention has been defined with respect to the particular arrangement shown in the drawing, it should be understood that various modifications may be made within the spirit of the invention, and that the embodiment shown is illustrative only and not restrictive of the invention.

We claim:

1. A band type spacer adapted to maintain a predetermined distance between spaced tubes, a housing, a bank of essentially parallel tubes in said housing, a first elongate strip member adjacent one side of said tube bank having spaced tabs formed uniformly at one side thereof and adapted to (that) extend laterally between tubes, a second strip member normal to said tabs confronting the opposite side of said tube bank and having a plurality of slots therein parallel to the longitudinal axis of said strip members spaced to receive the ends of the lateral tabs, a weldment on the outboard side of said second strip member connecting each tab thereto, openings in the first and second elongate strip members on opposite sides of the bank of parallel tubes, a tie rod traversing aligned openings to connect said strips into an integral assembly, weldments on the outboard sides of the first and second strip members adapted to bond the ends of the tie rods thereto, and support legs bonded to the surface of spaced tubes in said tube bank adapted to provide a support surface subjacent one of the lateral strips for the spacer assembly.

* * * * *